United States Patent [19]

Brockett, III et al.

[11] 3,972,566

[45] Aug. 3, 1976

[54] SOLIDS CONCENTRATOR

[75] Inventors: Frank Howard Brockett, III, Bellevue; Arthur Francis Sullivan, Redmond, both of Wash.

[73] Assignee: The International Nickel Company, Inc., New York, N.Y.

[22] Filed: Mar. 4, 1975

[21] Appl. No.: 555,117

[52] U.S. Cl. ..... 299/8; 37/57; 37/58; 37/DIG. 8

[51] Int. Cl.[2] ..... E02F 3/88; E02F 7/06

[58] Field of Search ..... 299/8; 37/DIG. 8, 57, 37/58, 59

[56] References Cited

UNITED STATES PATENTS

| | | | |
|---|---|---|---|
| 3,365,823 | 1/1968 | Vogt | 299/8 |
| 3,556,598 | 1/1971 | Smith | 299/8 |
| 3,675,348 | 7/1972 | Dane, Jr. | 299/1 |
| 3,697,134 | 10/1972 | Murray | 37/DIG. 8 |
| 3,748,248 | 9/1973 | Wanzenberg et al. | 299/8 X |
| 3,829,160 | 8/1974 | Condolios | 37/DIG. 8 |

*Primary Examiner*—Ernest R. Purser
*Assistant Examiner*—William F. Pate III
*Attorney, Agent, or Firm*—George N. Ziegler; Ewan C. MacQueen; Raymond J. Kenny

[57] ABSTRACT

Apparatus for separating various sizes of solid minerals, e.g., mixtures of fine sediment and larger particles or aggregates of ore, has rotating drum with internal lifters and external grousers and enables tumbling of solids in stream of water flowing through drum.

10 Claims, 8 Drawing Figures

SOLIDS CONCENTRATOR

The present invention relates to obtaining solid minerals and more particularly to deepsea mining.

It is well known that aggregates of useful and commercially desirable solid minerals have been found at the bottoms of the deep seas. At many places the desired aggregates, e.g., manganese nodules, are dispersed among undesired solids, much of which is in sizes larger or smaller than the desired solids. Apparatus and methods have been proposed for transporting desired solids up from the deepsea to the upper sea levels and to surface transport ships. Yet, upward transport of large amounts of undesired solids, such as sedimentary particles, silt and rocks, should be avoided or at least restricted in order to avoid waste of energy and inefficiency in use of apparatus and also to avoid possible pollution of the upper sea environment. It is highly desirable to have apparatus that can concentrate desired solids at the sea bottom. Particulars of this need include capability of functioning at the deepsea floor, possibly at depths of several miles, operability in mud and silt and avoidance of clogging difficulties, and operability without need for undersea motors or electrical power. In at least some important areas it is also beneficial for concentrating apparatus to have means for releasing or loosening the desired aggregates from the undersea floor.

There has now been discovered an apparatus adapted for concentrating desired sizes of solids while working without an undersea motor at sedimentary bottoms of the deep seas.

It is an object of the invention to provide an undersea solids concentrator.

Other objects and advantages of the invention will become apparent from the following description taken in conjunction with the accompanying drawing wherein.

Figure 1:
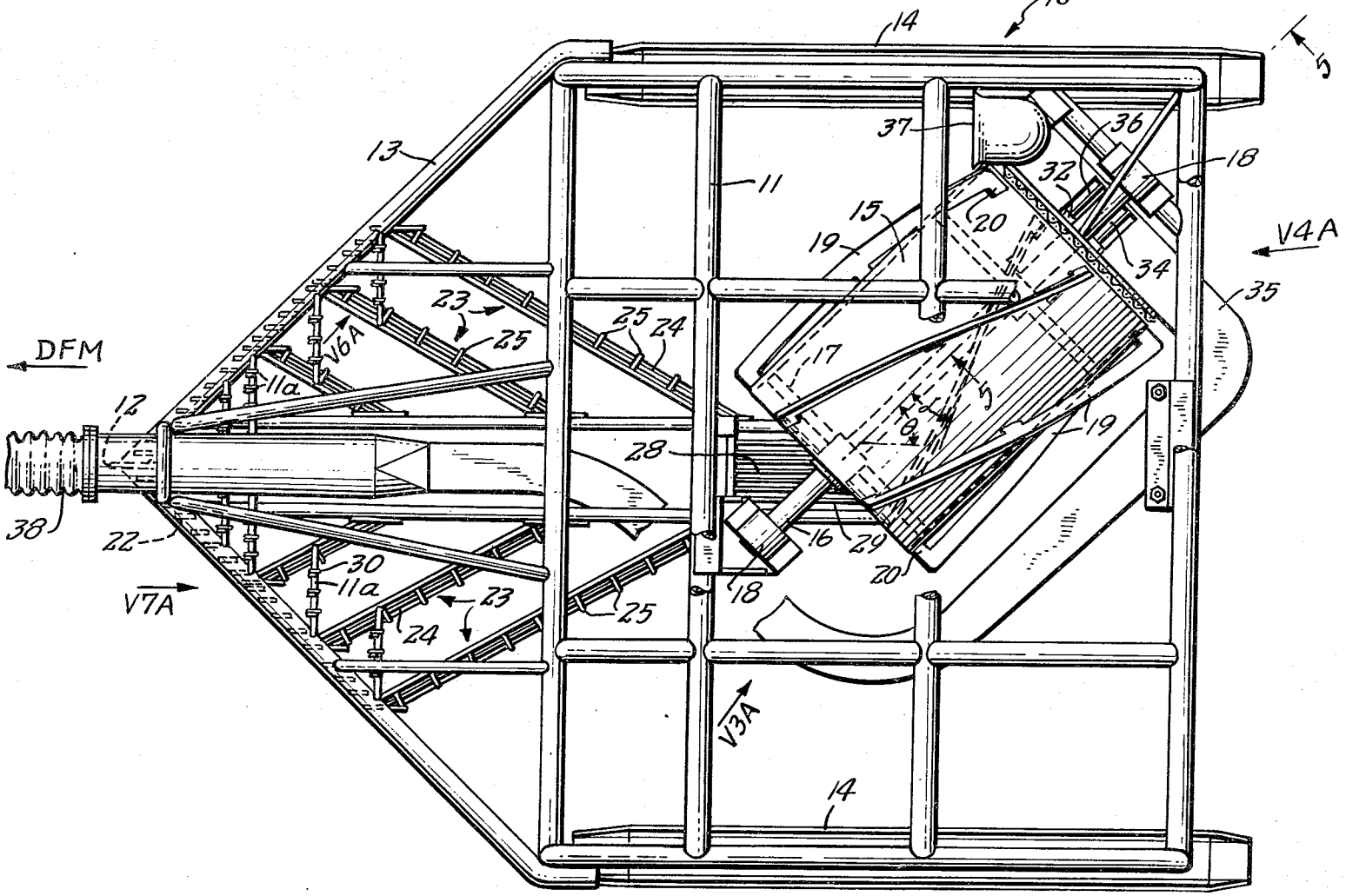
FIG. 1 is a plan view of an embodiment of the undersea solids concentrator vehicle of the invention.
Figure 2:
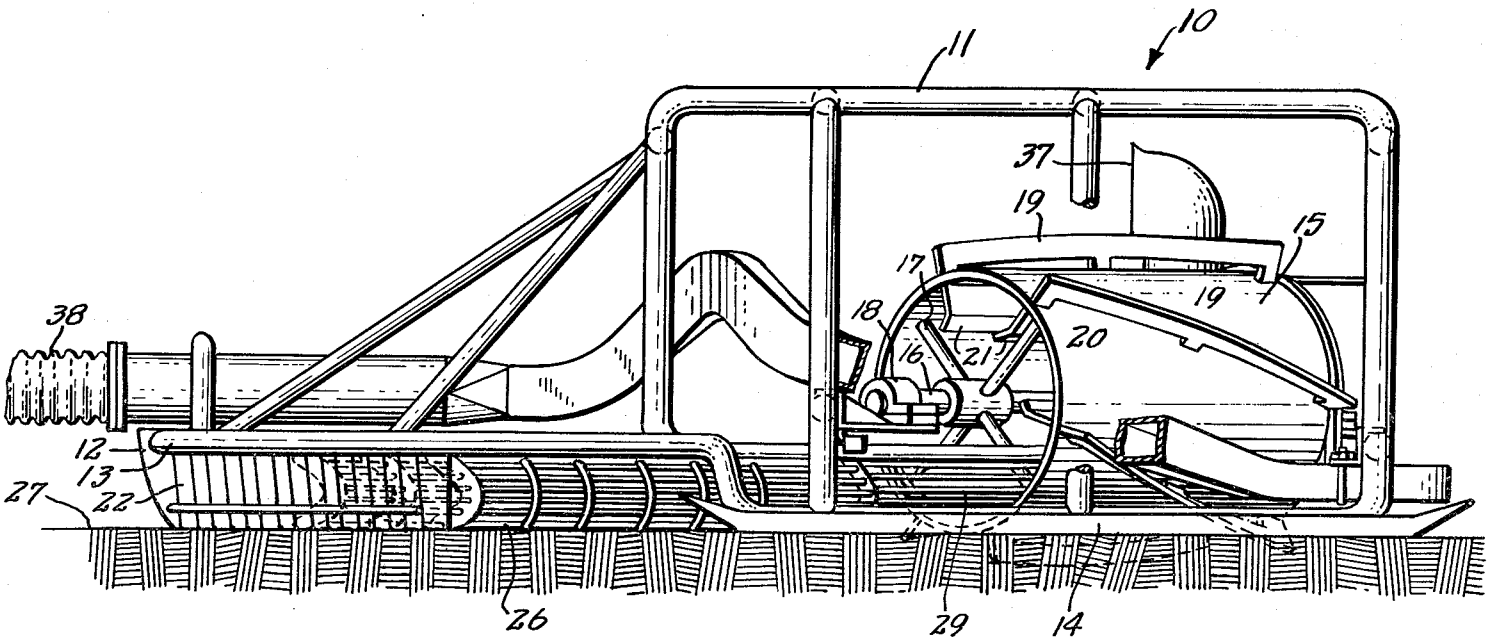
FIG. 2 is a side view of the embodiment of FIG. 1.
Figure 3:
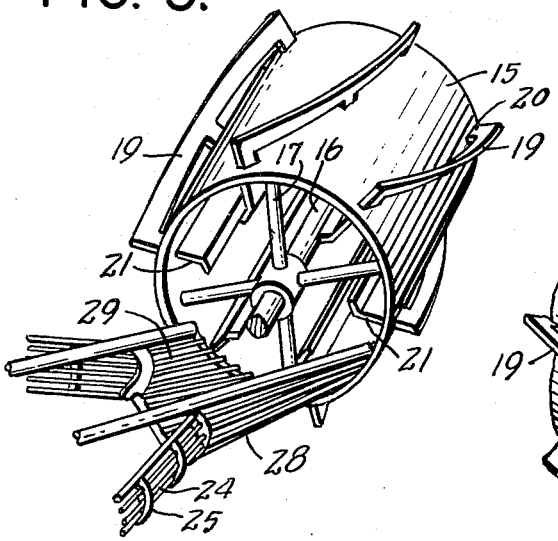
FIG. 3 is a perspective illustration of a collecting and concentrating portion of the embodiment of FIGS. 1 and 2 viewed from arrow V3A on FIG. 1.
Figure 4:
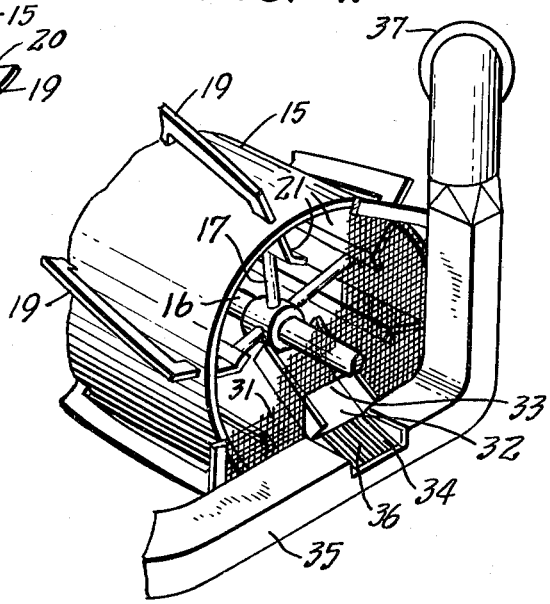
FIG. 4 is a perspective illustration of a concentrating and transmitting portion of the embodiment of FIGS. 1 and 2 viewed from the rear in the direction of arrow V4A on FIG. 1.
Figure 5:
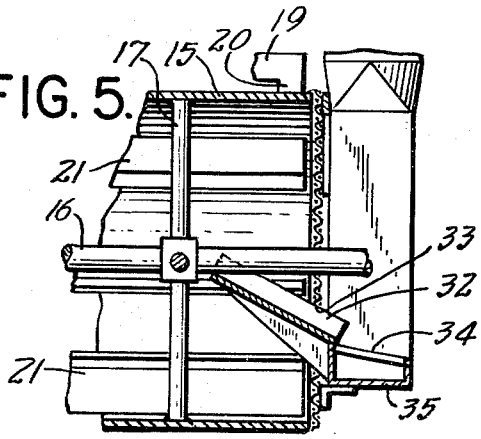
FIG. 5 is a side view, on an enlarged scale, of a vertical partial section along line 5—5 on FIG. 1.
Figure 6:
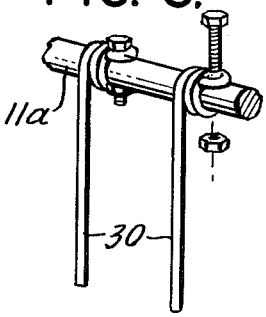
FIG. 6 is a perspective detail illustration of fluidizing tines and a framework portion of the embodiment of FIG. 1 viewed from arrow V6A on FIG. 1.
Figure 7:
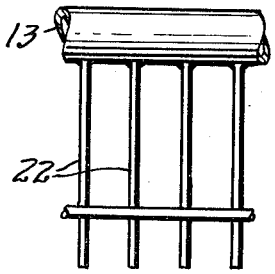
FIG. 7 is a detail illustration of rejection teeth and a bumper portion of the embodiment of FIG. 1 viewed from arrow V7A on FIG. 1.

The present invention contemplates a solids concentrator apparatus comprising a hollow cylinder (referred to as the concentrator drum) mounted to enable rotation around the central axis while holding the axis in a substantially horizontal position, external grousers for rotating the drum around the central axis when moved along the undersea floor, an entrance and a specially restricted exit for water and solids at the opposite ends of the drum cylinder, internal lifters fixed to the drum wall and adapted for lifting and dropping solids when the drum is rotated, and a transfer guide held in a fixed position for catching solids falling from the lifters and guiding the falling solids through the drum exit. The drum exit is specially restricted to exhaust undesired fines and direct desired sizes to a desired collection place. A collection and transfer conduit, or collection buckets or scoops, or other collection or transfer means, can be provided at the collection place outside the exit. Or, the concentrator can drop the solids out onto the sea floor in a special use to form a windrow of concentrated solids in the path travelled by the concentrator for subsequent collection and transport of the solids by other apparatus. Also, the concentrator can be in a combination with additional undersea mining apparatus for gathering or transporting desired undersea solids.

During forward movement on the undersea floor, water flows through the concentrator and washes silt and other undesirably fine particles away from the larger, desired, solids that are being raised and dropped by the lifters, e.g., paddles, scoops, buckets or internal grousers that are fixed to and rotate with the drum interior. Flow of water through the drum moves the solids rearward toward the exit. Also, the lifters can be adapted to move the solids rearward, e.g., with internal blades slanted or spiraled rearward. The restricted exit can have a fenestrated cover with a small central opening sufficient for passage of desired sizes to the transfer guide and with bars or screen wires spaced over most of the exit area to provide for discharge of fines while desired sizes are directed into the transfer passage.

The external grouser blades can be metal ribbons mounted as spirals around the cylindrical exterior of the drum, advantageously with spacers between the drum and blades. Spacing of the grouser blades modest distance, such as a one or two inches, or possibly four inches outward from the drum is beneficial for maintaining the grousers sufficiently clean to be effective as traction means for converting the forward motion power into rotational power and, thus, for avoiding having the blades load-up with mud or other sea floor sediment and incurring resultant loss in efficiency. Other contemplated traction means for rotating the drum include cleats, pegs and paddles.

If desired, water flow into the entrance can be enhanced with ducts, vanes, guides, e.g., a conical surface, mounted fixed in front of the drum. A rearwardly converging open-ended cone may be included in the drum, with lifters extending inside the cone, to assist direction of the solids to the drum exit.

The drum is mounted with the drum axis held horizontal and at a height that enables moving the drum along a soft undersea floor, in a preselected forward direction, with the bottom of the drum cylinder near the floor and the grousers extending into the floor. The axis can be parallel or perpendicular, or slanted, to the direction of forward movement. When the axis is perpendicular, guide vanes or ducting can be mounted to direct water flow through the drum. The grousers are aligned on the drum in relation to the forward direction to result in rotation of the drum around its central axis during forward movement. Forward movement power can be provided by towing from a ship or other powered vehicle. For good rotation power in deepsea silt certain undersea floor conditions, the optimum for the angle of the grouser blade to the direction of forward movement, when the blade is at the bottom of the circle of drum rotation, with the drum horizontally slanted at 45°, is herein deemed 67½°. The entrance of the drum is open, and advantageously faces at least partially forward, to provide for flow of water into and through the drum and out the exit during forward movement undersea. The drum axis is desirably slanted from the forward direction in order to benefit both rotational action with the grousers and water flow through the drum. For best results, the drum axis angle (horizontal angle of drum cylinder axis, projected down on floor, to forward direction, theta $\theta$, and the grouser blade angle (horizontal angle of grouser blade on sea floor to drum cylinder axis), alpha $\alpha$, are correlated to obtain desirable conversion of forward moving power to rotating power according to the characteristics of the undersea floor where the concentrator is to be used and to also obtain a good flow of water through the drum during forward movement. The drum axis angle can be from 0° to 90°. Advantageously, for benefitting rotation power on mud-like thick silt floors and also good flow of water through the drum, the drum axis angle is about 40° to about 50°, e.g., 45°, and the grouser angle is about 25° to about 20°, e.g., 22½°.

The mounting, e.g., shafts and bearings, of the rotatable concentrator drum can be supported by an undersea vehicle structure, which can be part of the structure of an undersea mining vehicle that serves mainly or practically solely for carrying the concentrator drum, or the drum mounting can be on the structure of an overall floor-to-surface collection-concentration-transportation system; possibly the present drum concentrator can be mounted to augment concentration in another concentrating system.

Advantageously, especially for mining manganese nodules, the concentrator drum of the invention is integrated in a concentrator vehicle having, inter alia, means for loosening and separating nodules or other aggregates from the sea floor and for directing desired sizes into the drum entrance, along with means for transporting nodules from the drum exit to the sea surface.

Inasmuch as the concentrator of the invention does not require external power other than the power for forward movement, such as is obtainable from towing with a riser conduit connected to a surface ship, and performs without necessity of having undersea electric motors or other motors of its own for rotation of the drum or for flow of water through the drum, or for other powered operations, the concentrator of the invention may be considered or referred to as being of the passive type.

Turning now to the drawing, FIGS. 1 through 8 refer to an undersea mining vehicle, or portions thereof, designated generally by numeral 10. The vehicle structure is adapted for forward movement in a direction indicated by arrow DFM on FIG. 1. Vehicle 10 includes support and rollbar framework 11, pavement rider 12 and bumper 13 mounted on sliding runners 14. Drum 15 has axle 16 held by spokes 17 and is rotatably supported with the axle in bearings 18. Grousers 19 are supported at a space away from the drum by posts 20. Lifting paddles 21 are attached to the interior face of the drum. Rejection teeth 22 are suspended from the bumper and extend down to or into the floorline level on which the bottom surfaces of the runners slide.

Collection sweep wings 23 have collection bars 24 held horizontal and mutually parallel by ribs 25.

The rejection teeth are spaced apart sufficiently to enable passage of desired sizes of aggregates and yet are sufficiently close together to reject oversize solids, e.g., rocks. The collection wing bars are held sufficiently close together to prevent outward passage of a portion or all of the desired sizes of aggregates while yet being sufficiently open for releasing undesired fine material, e.g., silt. The illustrated vehicle has three pairs of collection wings. The bars in each wing are successively spaced more closely together with the smallest spacings being at the most aft location and sufficiently close to prevent outward passage of the smallest of the desired sizes of aggregates. The wings are in rearwardly converging positions that direct desired aggregates toward the entrance of the drum.

The vehicle framework supports the sweeps with the lower leading edges 26 at floorline level 27, as located by the bottom surfaces of the runners. Collection grate 28 has forwardly and upwardly sloping grating bars 29 that are adapted to direct desired sizes of aggregates into the front of the drum. Fluidizing tines 30, suspended from framework bars 11a, are adapted by length and flexibility to extend down to and into the floorline, where relatively soft, and to loosen floor material and desired aggregages, and yet permit passage of desired sizes aftward.

In use, as the vehicle is moved in a forward direction over an undersea floor having desired sizes of aggregates mixed with other material at the floor, the rejection teeth push undesired large articles out of the way of the vehicle, the fluidizing tines loosen floor material; and the collection sweep wings force desired sizes of solids inward toward the center line of the vehicle and thus in front of the collection grate. The collection gate directs the desired material into the drum. When the vehicle is moving forward, the grouser blades rotate the drum on its axis and the paddles attached to the inside of the rotating drum lift and drop the solids in the drum while the forward motion also has the effect of passing a flow of water rearward through the drum, thus combining with the lifting and dropping action to result in washing of the solids materials and separating of undesired fines, which are carried to the rear and out through discharge screen 31 at the aft opening of the drum.

As the solids move aftwards, the desired sizes cannot pass through the screen and are tumbled in the drum and eventually dropped onto collection chute 32 through collection passage opening 33 and then move down the chute and fall from the chute into solids entrance 34 of conveyance duct 35. The solids entrance has grizzly bars 36 for preventing entrance of any oversize solids that may have passed the rejection teeth.

The drum axis angle and the grouser blade angle are depicted by angles $\theta$ and $\alpha$, respectively, on FIG. 1.

Figure 8:
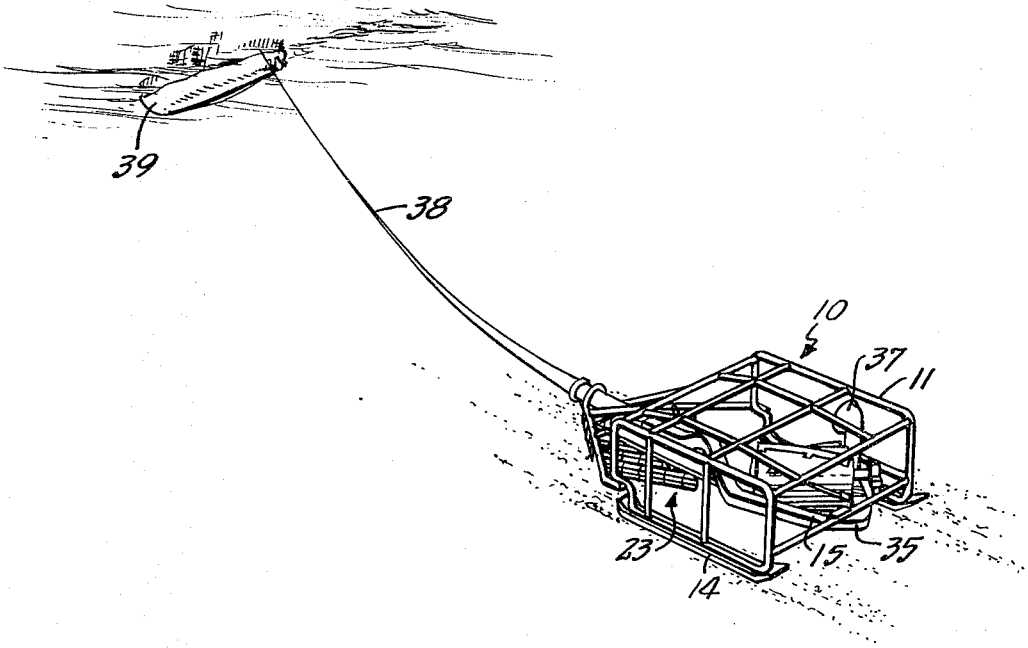
FIG. 8 is a perspective view illustrating an embodiment of the vehicle of the invention deployed for undersea mining operations in conjunction with a hydraulic suction transport riser and a surface ship.

A flow of water is drawn into elevated water inlet 37, and also into the solids entrance, and flows through the conveyance duct and thence into hydraulic transport conduit (or riser) 38 by hydraulic suction power furnished from an external power source, which can be in a surface ship. Also, the vehicle can be towed with the conduit attached to the ship and the vehicle. FIG. 8 illustrates vehicle 10 being towed with riser conduit 38 attached to ship 39.

For carrying the invention into practice, it is recommended that the axial length of the drum be greater than the diameter, e.g., drum length 1¼ or 1½ or more times drum diameter. The framework can be constructed of welded or bolted tubing, bars or angles or other structural shapes. If desired, a remotely operable shutter can be provided at the solids entrance of the conveyance duct to enable shutting-off the entry of solids and enabling drawing clear water through the the ducting and conduit, for purposes such as for flushing the ducting or starting the riser suction pumps. Or a gate for clear water can be provided at a more forward position on the duct, such as near the elevated elbow on the illustrated vehicle.

The present invention is particularly applicable in the undersea preparation of concentrations of desired solid mineral aggregates for upward transportation to the surface. Undersea concentration of desired aggregates is beneficial toward saving energy that otherwise might be wasted by upward transport of undesired material and, also, avoids unnecessary contamination of the upper sea environment with unwanted deepsea material. Deepsea concentration of manganese nodules, and the cleansing thereof from silt and other sediment, are among the contemplated commercial applications of the invention.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

We claim:

1. A undersea mining vehicle for providing a concentration of desired sizes of solid mineral aggregates that are found dispersed at the level of an undersea floor comprising:

a. a vehicle structure adapted for being moved in a forward direction on an undersea floor;

b. a concentrator drum having the configuration of a hollow cylinder with an entrance at one end and an exit at the opposite end;

c. a mounting for supporting the drum with the drum axis horizontal and with the lower periphery at the undersea floor, said mounting being on the vehicle and supporting the drum rotatably around the central axis of the drum;

d. traction means, attached to the exterior periphery of the drum, for engaging the undersea floor and rotating the drum around the drum axis when the vehicle is moved in the forward direction on the undersea floor;

e. means for contacting, moving and directing desired sizes of aggregates of undersea floor solids into the drum entrance and for rejecting undesirably large solids away from the entrance when the vehicle is moved forward;

f. solids lifters inside the drum and connected to move with the interior of the drum around the drum axis during rotation of the drum and thereby lift solids from the lower portion of the drum and then drop the solids towards the drum axis;

g. a transfer guide mounted in fixed position for catching solids falling from the lifters and for guiding the falling solids through the drum exit;

h. a screen disposed across the space between the drum exit and the exit end of the drum cylinder for preventing passage of desired solids outward except through the exit and for enabling outward flow of water and undesirably fine solids during forward motion of the vehicle; and i. means for directing a flow of desired solids from the drum exit to a desired location.

2. A vehicle as set forth in claim 1 wherein the vehicle structure comprises two sliding runners disposed parallel to the centerline of the vehicle and with the concentrator drum between the runners.

3. A vehicle as set forth in claim 1 whereon the central axis of the concentrator drum is at a horizontal angle of about 40° to 50° to the centerline of the vehicle.

4. A vehicle as set forth in claim 1 wherein the traction means comprises grouser blades extending outwards from the exterior of the drum.

5. A vehicle as set forth in claim 4 wherein the grouser blades are at angles of about 20° to 25° to the central axis of the drum and the axis of the drum is disposed at a horizontal angle of about 40° to 50° to the centerline of the vehicle.

6. A vehicle as set forth in claim 4 whereon the axis of the drum and the angles of the grouser blades are disposed to provide that the grouser blades are at an angle of about 67½° to the direction of forward direction of movement of the vehicle when each grouser blade is at the bottom of the circle of drum rotation.

7. A vehicle as set forth in claim 1 whereon the means for rejecting undesirably large solids away from the drum entrance and the means for directing desired sizes of aggregates into the drum comprises vertically disposed rejection teeth and converging collection sweeps having horizontal collection bars.

8. A vehicle as set forth in claim 1 having fluidizing tines extending downward from the forward portion of the vehicle structure.

9. A vehicle as set forth in claim 1 whereon the means for directing a flow of desired solids from the drum exit to a desired location comprises a conveyance duct disposed behind the drum and adapted to be connected to a hydraulic suction transport conduit.

10. In an apparatus for deepsea mining of solid mineral aggregates of desired sizes dispersed at a deepsea floor, said apparatus including means for gathering solids from the floor, for transporting the gathered solids upward from the sea floor, and means for moving the apparatus in a preselected forward direction over the sea floor, the improvement comprising, in combination therewith between the gathering means and the upward transport means, and connected to the forward movement means:

1. a hollow cylindrical concentrator drum having a. an entrance for water and solids at one end and a restricted exit for desired sizes of solids at the opposite end and also, at said opposite end, a discharge means for outward flow of water and undesirably fine solids;

b. traction means on the cylinder exterior for engaging the sea floor and rotating the drum around its central axis during movement in the forward direction;

c. lifting means connected to the drum interior for lifting solids from the lower portion of the drum and dropping the lifted solids toward the central axis of the drum when the drum is rotated around the central axis; and d. solids guide means for catching and guiding the falling solids through the exit of the drum and into the upward transport means; and 2. a vehicular structure, including a drum mount holding the drum rotatable around the central axis of the drum, adapted for maintaining the drum axis at a horizontal angle in the range of about 40° to about 50° to the direction of forward movement and with the drum entrance opening forwardly and disposed more forward than the drum exit when the apparatus is moved forward on the sea floor.

* * * * *